US007982182B2

(12) United States Patent
Hashimoto et al.

(10) Patent No.: US 7,982,182 B2
(45) Date of Patent: Jul. 19, 2011

(54) MASS SPECTROMETER AND MASS SPECTROMETRY METHOD

(75) Inventors: Yuichiro Hashimoto, Tachikawa (JP); Hideki Hasegawa, Tachikawa (JP); Masayuki Sugiyama, Hino (JP)

(73) Assignee: Hitachi High-Technologies Corporation, Tokyo (JP)

( * ) Notice: Subject to any disclaimer, the term of this patent is extended or adjusted under 35 U.S.C. 154(b) by 230 days.

(21) Appl. No.: 12/472,899

(22) Filed: May 27, 2009

(65) Prior Publication Data

US 2009/0294661 A1 Dec. 3, 2009

(30) Foreign Application Priority Data

May 28, 2008 (JP) ..... 2008-138859

(51) Int. Cl.
*H01J 49/00* (2006.01)
*H01J 3/40* (2006.01)

(52) U.S. Cl. ..... 250/282; 250/292

(58) Field of Classification Search ..... 250/290–293
See application file for complete search history.

(56) References Cited

U.S. PATENT DOCUMENTS

| | | | | |
|---|---|---|---|---|
| 5,420,425 | A | 5/1995 | Bier et al. | |
| 5,783,824 | A | 7/1998 | Baba et al. | |
| 6,177,668 | B1 * | 1/2001 | Hager | 250/282 |
| 7,348,554 | B2 | 3/2008 | Hashimoto et al. | |
| 7,709,786 | B2 * | 5/2010 | Konenkov et al. | 250/282 |
| 2003/0160169 | A1 * | 8/2003 | Baba et al. | 250/292 |
| 2004/0065824 | A1 * | 4/2004 | Bateman et al. | 250/288 |
| 2007/0181804 | A1 * | 8/2007 | Hashimoto et al. | 250/290 |

* cited by examiner

*Primary Examiner* — Jack I Berman
*Assistant Examiner* — David Smith
(74) *Attorney, Agent, or Firm* — Mattingly & Malur, PC

(57) ABSTRACT

The present invention relates to an ion trap with a large trap capacity. A mass spectrometer comprises a first linear ion trap that performs mass selective ejection, and a second linear ion trap that accumulates and then mass selectively ejects ions ejected from the first linear ion trap. Directions of resonant excitation of ions of the first linear ion trap and of the second linear ion trap are orthogonal. Compared to conventional art, sensitivity is significantly improved.

18 Claims, 7 Drawing Sheets

MASS SPECTROMETER AND MASS SPECTROMETRY METHOD

CLAIM OF PRIORITY

The present application claims priority from Japanese patent application JP 2008-138859 filed on May 28, 2008, the content of which is hereby incorporated by reference into this application.

BACKGROUND OF THE INVENTION

1. Field of the Invention

The present invention relates to a mass spectrometer and a mass spectrometry method.

2. Background Art

Ion traps, which have high sensitivity characteristics, are widely used in mass spectrometers. Of such ion traps, linear ion traps comprising quadrupole rods are capable of high sensitivity analysis because the amount of ions that can be trapped internally at one time (the trap capacity) is greater than conventional 3D traps (approximately 1,000 to 10,000), and are widely used.

Patent Document 1 discloses a method of mass selectively ejecting ions in a direction orthogonal to quadrupole rods after the ions are accumulated in a linear ion trap. With this method, a trap capacity of approximately 100,000 is achieved.

Patent Document 2 discloses the mass selective ejection of ions in the axial direction of quadrupole rods using a fringing field that occurs at an exit end portion of the quadrupole rods after the ions are accumulated in a linear ion trap. With this method, a trap capacity of approximately 100,000 is achieved.

Patent Document 3 discloses the mass selective ejection of ions in the axial direction of quadrupole rods using an extraction field that is generated with a wire electrode after the ions are accumulated in a linear ion trap. With this method, a trap capacity of approximately 100,000 is achieved.

Patent Document 4 discloses mass selective ejection in the axial direction using a harmonic potential that is formed in the axial direction after ions are accumulated in a linear ion trap. With this method, a trap capacity of approximately 100,000 is achieved.

In Patent Document 5, the mass selective linear ion trap portions disclosed in Patent Document 1, Patent Document 2, and Patent Document 4 are coupled in tandem, rough mass dissociation is performed at a first stage linear ion trap, and high accuracy mass dissociation is performed at a second stage linear ion trap. There is disclosed a method of improving the trap capacity for ions by a digit or more by controlling these traps in coordination.

[Patent Document 1] U.S. Pat. No. 5,420,425

[Patent Document 2] U.S. Pat. No. 6,177,668

[Patent Document 3] U.S. Patent Publication No. 2007/0181804

[Patent Document 4] U.S. Pat. No. 5,783,824

[Patent Document 5] U.S. Pat. No. 7,348,554

SUMMARY OF THE INVENTION

With Patent Document 1, Patent Document 2, Patent Document 3, and Patent Document 4, in order to maintain the mass accuracy of the ions ejected from the linear ion trap, it is necessary to limit the trap capacity to approximately 100,000. On the other hand, in order to attain a high duty cycle, a large trap capacity is necessary. It is known that the ion introduction amount into an ion trap in an ordinary mass spectrometer is approximately 10,000,000 cps. If, hypothetically, the ion trap is operated at 2 cycles/sec, the duty cycle would be (100,000×2)/10,000,000=2%. It can be seen that only an extremely low duty cycle can be attained.

With Patent Document 5, it is possible to improve the duty cycle by a digit or more as compared to Patent Document 1, Patent Document 2, Patent Document 3, and Patent Document 4. However, there are problems with the accuracy of the mass dissociation of the second stage. This is because the spread of the ejection energy of the ions ejected from the linear ion trap of the first stage is large, and the accuracy of the mass ejection from the linear ion trap of the second stage is lowered due to such spreads.

In order to solve the problems above, a mass spectrometer of the present invention comprises:

an ion source that ionizes a sample;

a plurality of linear ion trap portions that are disposed at stages subsequent to the ion source, and that perform trapping and mass selective ejection of ions;

a detector that is disposed at a stage subsequent to the plurality of linear ion trap portions, and that detects ions; and a control portion that controls a voltage applied to electrodes forming the above-mentioned plurality of linear ion trap portions, wherein the control portion applies the voltage in such a manner that resonant excitation directions, in radial directions that are orthogonal to an axial direction of the linear ion trap portions, of ions trapped in, of the plurality of linear ion trap portions, adjacent linear ion trap portions are different or substantially orthogonal.

In addition, in the above-mentioned mass spectrometer, if the plurality of linear ion trap portions comprise a first linear ion trap portion and a second linear ion trap portion, the control portion applies a voltage in such a manner that the resonant excitation directions, in the radial directions that are orthogonal to the axial direction of the linear ions trap portions, of the ions trapped in the first linear ion trap portion and of the ions trapped in the second linear ion trap portion are different.

Further, a mass spectrometry method of the present invention uses a mass spectrometer in which ions generated by an ion source are introduced, and which comprises two or more linear ion trap portions, and the method comprises:

a step of resonantly exciting in a first resonant excitation direction ions trapped in a first linear ion trap portion of the two or more linear ion trap portions, and mass selectively ejecting the ions in a center axial direction of quadrupole rods;

a step of trapping in a second linear ion trap portion the ions ejected from the first linear ion trap portion, resonantly exciting the trapped ions in a second resonant excitation direction that is different from the first resonant excitation direction in a radial direction that is orthogonal to an axial direction of the linear ion trap portions, and mass selectively ejecting the ions; and a step of introducing the ions ejected from the second linear ion trap portion to a detection process.

An effect of the present invention is the provision of an ion trap that simultaneously achieves trap capacity and mass accuracy.

DESCRIPTION OF SYMBOLS

Figure 1:
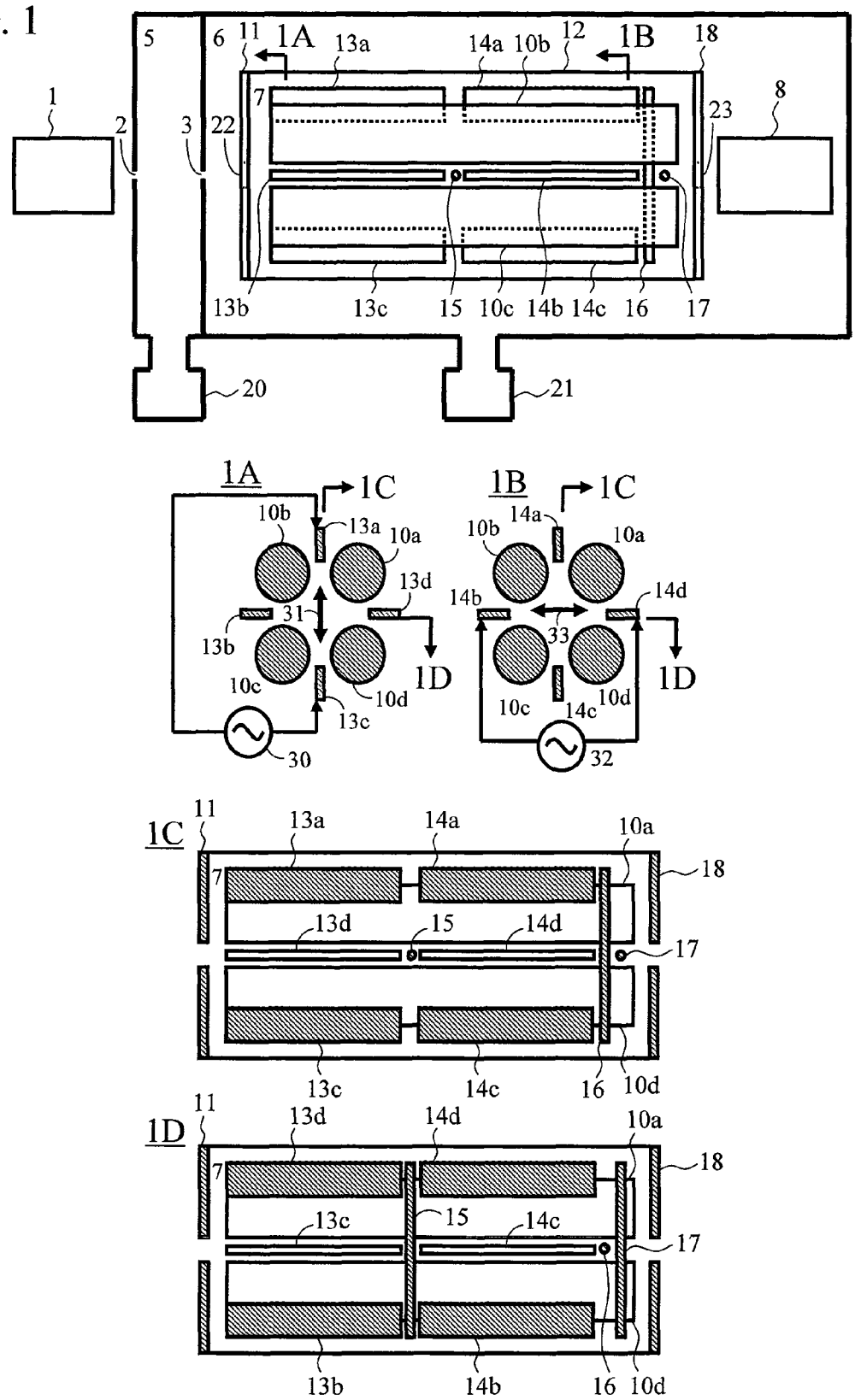
FIG. 1 shows Embodiment 1 of the present system.

1 . . . Ion source
2 . . . First orifice
3 . . . Second orifice
5 . . . Differential pumping region
6 . . . Vacuum chamber
7 . . . Trap chamber
10 . . . Quadrupole rods
11 . . . Inlet electrode
12 . . . Outer cylinder portion
13 . . . Vane electrodes
14 . . . Vane electrodes
15 . . . Wire electrode
16 . . . Wire electrode
17 . . . Wire electrode
18 . . . Exit electrode
20 . . . Vacuum pump
21 . . . Vacuum pump
22 . . . Orifice
23 . . . Orifice
30 . . . Supplemental AC voltage
31 . . . Resonant excitation direction
32 . . . Supplemental AC voltage
33 . . . Resonant excitation direction
40 . . . Quadrupole rods
41 . . . Quadrupole rods
42 . . . Quadrupole rods
43 . . . Wire electrode
44 . . . Wire electrode
45 . . . Supplemental AC voltage
46 . . . Resonant excitation direction
47 . . . Supplemental AC voltage
48 . . . Resonant excitation direction
49 . . . Supplemental AC voltage
50 . . . Resonant excitation direction
51 . . . Ion source
52 . . . End electrode
53 . . . Quadrupole rods
54 . . . End electrode
55 . . . End electrode
56 . . . Quadrupole rods
57 . . . End electrode
58 . . . End electrode
59 . . . Detector
67 . . . Quadrupole rods
68 . . . Quadrupole rods
69 . . . Accelerating electrode
70 . . . Reflectron
71 . . . Detecting portion
73 . . . Outer cylinder portion
74 . . . End electrode
75 . . . Resonant excitation direction
76 . . . Resonant excitation direction
80 . . . Opening

DETAILED DESCRIPTION OF THE PREFERRED EMBODIMENTS

Embodiment 1

Figure 2:
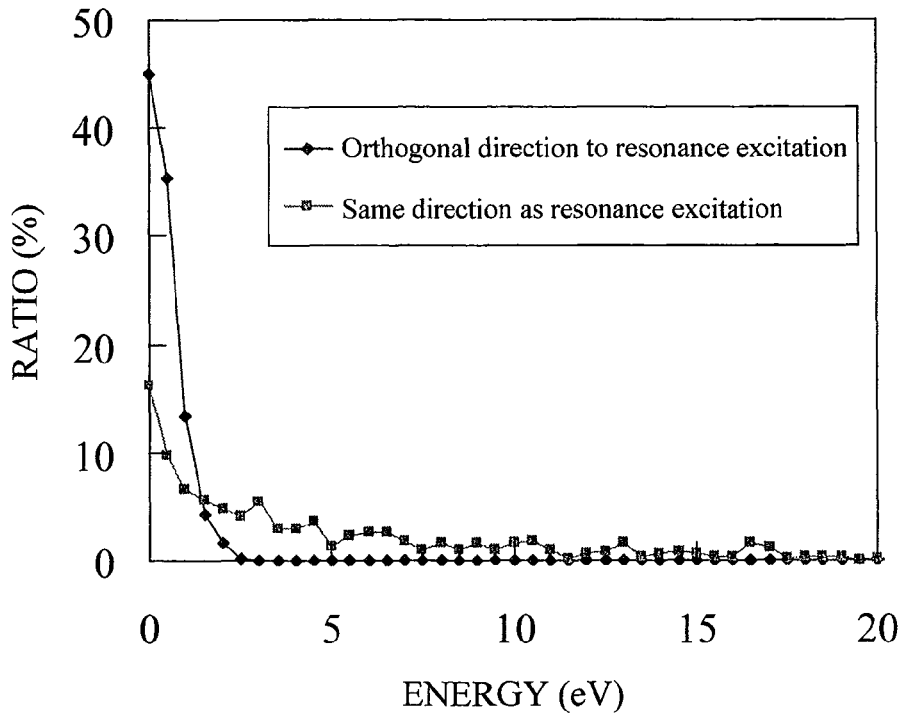
FIG. 2 is an illustrative view of effects of Embodiment 1 of the present system.

FIG. 1 is a configuration diagram of a linear ion trap to which the present system is applied. Ions generated at an ion source 1 pass through a first orifice 2, and are introduced into a differential pumping region 5 that is evacuated by a vacuum pump 20. Then, the ions pass through a second orifice 3, and are introduced into a vacuum chamber 6 that is evacuated to $10^{-6}$ Torr to $10^{-4}$ Torr by a vacuum pump 21. Then, the ions pass through an orifice 22, and are introduced into a linear ion trap chamber 7. The linear ion trap chamber 7 is enclosed by an end electrode (inlet electrode) 11, an outer cylinder 12, and an end electrode (exit electrode) 18, and a gas is introduced thereinto by a gas supplying portion (not shown). A noble gas, such as helium, argon or the like, nitrogen, or the like is used as the supplied gas, and the pressure in the linear ion trap chamber 7 is maintained at approximately $10^{-4}$ Torr to $10^{-2}$ Torr. The ions introduced into the linear ion trap chamber 7 are first introduced into a space (defined as a first ion trap portion) enclosed by the inlet electrode 11, quadrupole rods 10, vane electrodes 13, and a wire electrode 15. The ions can be trapped in the axial direction of the quadrupole rods 10 by applying a DC voltage of approximately 2-30 V to the inlet electrode 11 and the wire electrode 15. For each wire electrode, in order to prevent ion loss due to ion collision, a diameter of 50 μm or less is preferable. RF voltages (approximately 1 MHz, ±5 kV) whose phases are inverted alternately are applied to the quadrupole rods 10. As a result, a pseudo harmonic potential is formed in a radial direction that is orthogonal to the axial direction of the rods. With respect to the ions trapped in the first ion trap portion, ions with a specific mass can be resonantly excited by applying a supplemental AC voltage 30 (approximately 300 kHz, ±100 V) to opposing vane electrodes (13*a* and 13*c*). The correspondence between supplemental AC frequency and resonant ion mass is disclosed in Patent Document 3. In accordance with this relationship, by applying a supplemental AC voltage, ions of a specific mass are sequentially resonantly excited, surmount the potential of the wire electrode 15, and are mass selectively ejected from the first ion trap portion. In order to perform ion ejection efficiently, an extraction voltage of approximately 5-50 V is applied to the vane electrodes 13 and vane electrodes 14. The ions ejected from the first ion trap portion are introduced into a space (defined as a second ion trap portion) enclosed by the wire electrode 15, the quadrupole rods 10, the vane electrodes 14, and a wire electrode 16. The ions can be trapped in the axial direction by applying a DC voltage of approximately 2-30 V to the wire electrode 15 and the wire electrode 16. RF voltages (approximately 1 MHz, ±5 kV) whose phases are inverted alternately are applied to the quadrupole rods 10. As a result, a pseudo harmonic potential is formed in a radial direction that is orthogonal to the axial direction of the rods. With respect to the ions trapped in the second ion trap portion, ions with a specific mass can be resonantly excited by applying a supplemental AC voltage 32 (approximately 300 kHz, ±100 V) to opposing vane electrodes (14*b* and 14*d*). In so doing, it is extremely effective to set an ion excitation direction 31 of the first ion trap portion and an ion excitation direction 33 of the second ion trap portion in orthogonal directions. Reasons therefor are indicated below. After the ions excited in the first ion trap portion are excited in the direction of 31, they are introduced into the second ion trap portion and ion cooling proceeds. In order to attain good mass resolution in the second ion trap portion, it is necessary to perform sufficient ion cooling, and reduce initial energy distribution. However, if a long cooling time is set for this purpose, a waiting time occurs, and there arises a problem that sufficient duty cycles may not be attained. Thus, in order to make the cooling time short while performing sufficient cooling, the excitation directions of the first ion trap portion and the second ion trap portion are made orthogonal. FIG. 2 shows the energy distribution in the resonant excitation direction and the direction orthogonal thereto of the ions ejected from the first ion trap portion. The ions ejected from the first ion trap portion have a large energy distribution of 5.6 eV with respect to the excitation direction 31. However, in the direction orthogonal thereto, they converge towards a small energy distribution of 0.4 eV, which is about 1/10. As a result, it was found that the time required for subsequent cooling is significantly shorter in the orthogonal direction. In other words, by setting the resonant excitation direction of the second ion trap portion such that it is orthogonal to the resonant excitation direction of the first ion trap portion, ejection of high mass accuracy with a short cooling time is made possible. Thus, it is possible to attain high duty cycles. The ejected ions pass through the orifice 23 in the exit electrode 18, and are detected by a detector 8.

Figure 3:
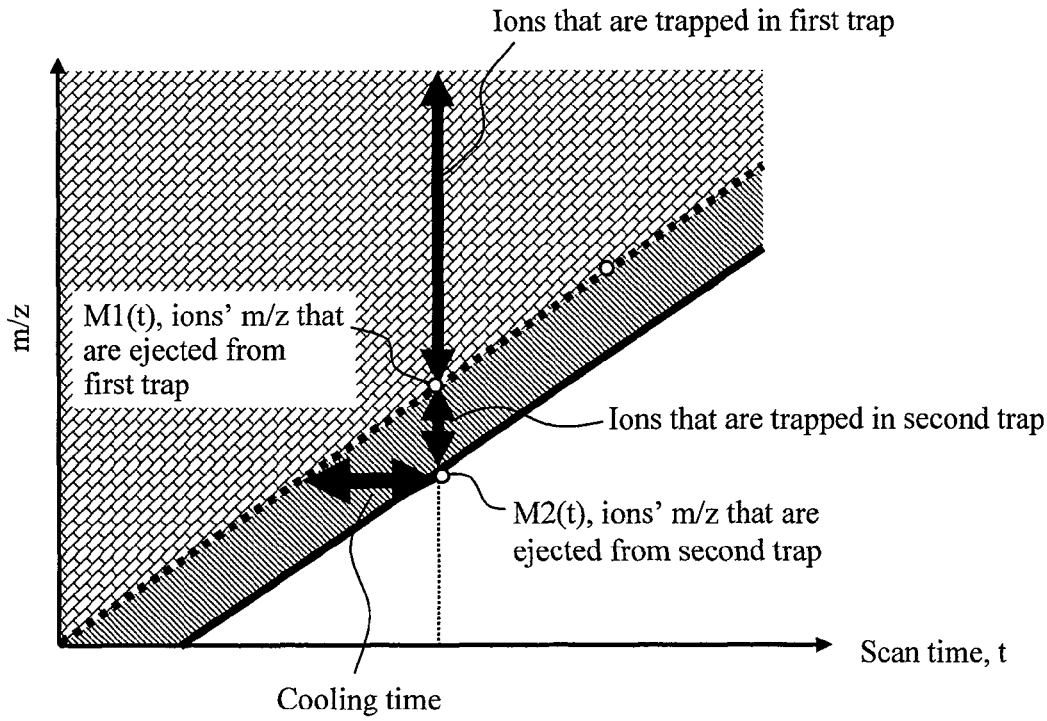
FIG. 3 shows a measurement sequence of Embodiment 1 of the present system.

Coordinated control is performed with respect to each of the first ion trap portion and the second ion trap portion. An example thereof is shown in FIG. 3. FIG. 3 shows on the horizontal axis the time from when the scan is started, and the mass number on the vertical axis. First, mass selective ejection of the ions from the first ion trap portion begins. Then, mass selective ejection from the second ion trap portion also begins. With respect to a given scan time t, only ions within a mass range between a mass M1(t) of the ions ejected from the first ion trap portion and a mass M2(t) of the ions ejected from the second ion trap portion would exist in the second ion trap portion. On the other hand, since conventional ion traps accumulate within the ion trap all ions with a mass exceeding the ejection mass, space charge is likely to occur, thereby limiting trap capacity. In the present invention, by performing such coordinated control of the first ion trap portion and the second ion trap portion, space charge can be improved significantly, and thus duty cycles can be improved. Further, by setting the excitation directions in orthogonal directions in the first ion trap portion and the second ion trap portion as is done in Embodiment 1, the ion cooling time can be made short. Thus, the mass range of the ions accumulated in the second ion trap portion can be made narrow. Further, duty cycles can be improved. In the present embodiment, undivided quadrupole rods are used, and an offset potential is applied to the vane electrodes to set the offset potential of each ion trap portion. However, the quadrupole rods may also be divided, superimposing an offset potential on each.

Embodiment 2

Figure 4:
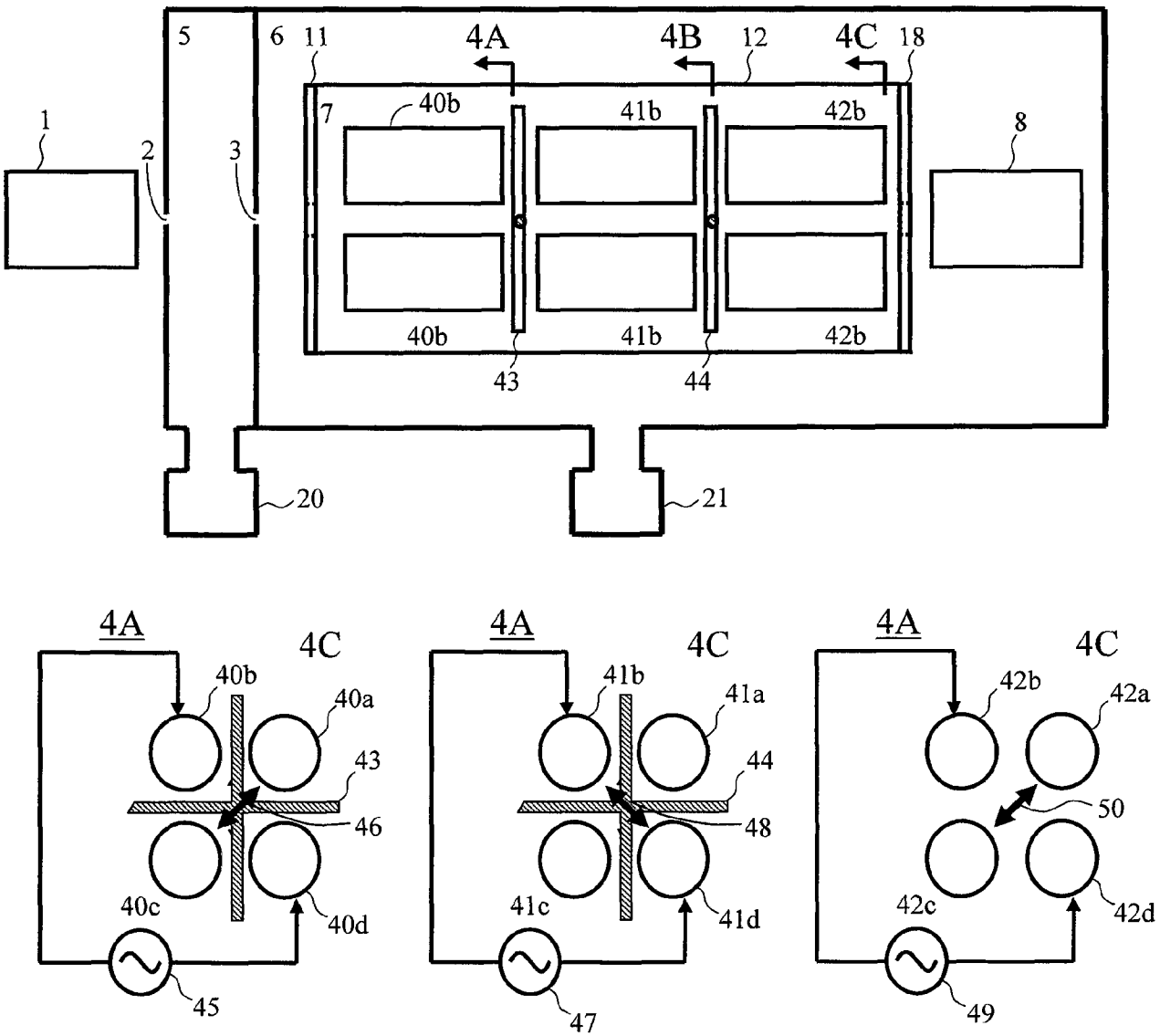
FIG. 4 shows Embodiment 2 of the present system.

FIG. 4 is a configuration diagram of a second embodiment of a linear ion trap to which the present system is applied. The system from the ion source up to the first ion trap portion is similar to Embodiment 1. In Embodiment 2, the trap is divided into three parts. RF voltages (approximately 1 MHz, ±5 kV) whose phases are inverted alternately are applied to each of quadrupole rods 40, 41, and 42. As a result, a pseudo harmonic potential is formed in a radial direction that is orthogonal to the axial-direction of the rods. Further, a voltage of approximately 2-30 V with respect to the quadrupole rods is applied to wire electrodes 43 and 44, and end electrodes (inlet and exit electrodes) 11 and 18, thus making accumulation in the axial direction possible in each ion trap portion. By using vane electrodes, ions can be resonantly excited in the center directions (31 and 33) of the quadrupole rods. However, by superimposing supplemental AC voltages 45, 47, and 49 on the quadrupole rods, ions can be resonantly excited in directions (46, 48, and 50) of opposing quadrupole rods. Further, offset potentials of approximately 5-20 V are applied to the quadrupole rods 40, 41, and 42 of the respective ion trap portions. For example, during measurement of positive ions, an offset potential of 20 V is applied to the quadrupole rods 40, 10 V to the quadrupole rods 41, and 0 V to the quadrupole rods 42. As a result, the resonantly excited ions mass selectively surmount the potential barriers formed by the wire electrodes 43 and 44, as well as the exit electrode 18, and are ejected towards the ion trap portions of subsequent stages and towards the detector 8. In so doing, the resonant excitation direction 46 of the first ion trap portion and the resonant excitation direction 48 of the second ion trap portion, as well as the resonant excitation direction 48 of the second ion trap portion and the resonant excitation direction 50 of the third ion trap portion, are set in orthogonal directions. As a result, as was shown in Embodiment 1, there are effects where cooling in the ion trap portions of subsequent stages (the second ion trap portion and the third ion trap portion) proceeds at high speed, and the mass accuracy of the ejected ions is improved. The effects of the present invention, as described in Embodiment 1, are that, by controlling a plurality of ion trap portions in coordination, the mass range in the final ion trap portion is limited, thereby reducing space charge, and improving duty cycles. It is obvious that further effects over coordinated control of two ion trap portions can be expected by controlling three ion trap portions in coordination. In the present embodiment, the quadrupole rods were divided, and an offset potential was superimposed on each. However, it is also possible to use undivided quadrupole rods, and, as in Embodiment 1, set the offset potential of each ion trap portion by applying an offset potential to vane electrodes. Further, in Embodiment 2, ejection from the third ion trap portion is performed using the fringing field of the end electrode. However, the effects of the present invention can be expected with other types of mass selective ejection methods as well.

Embodiment 3

Figure 5:
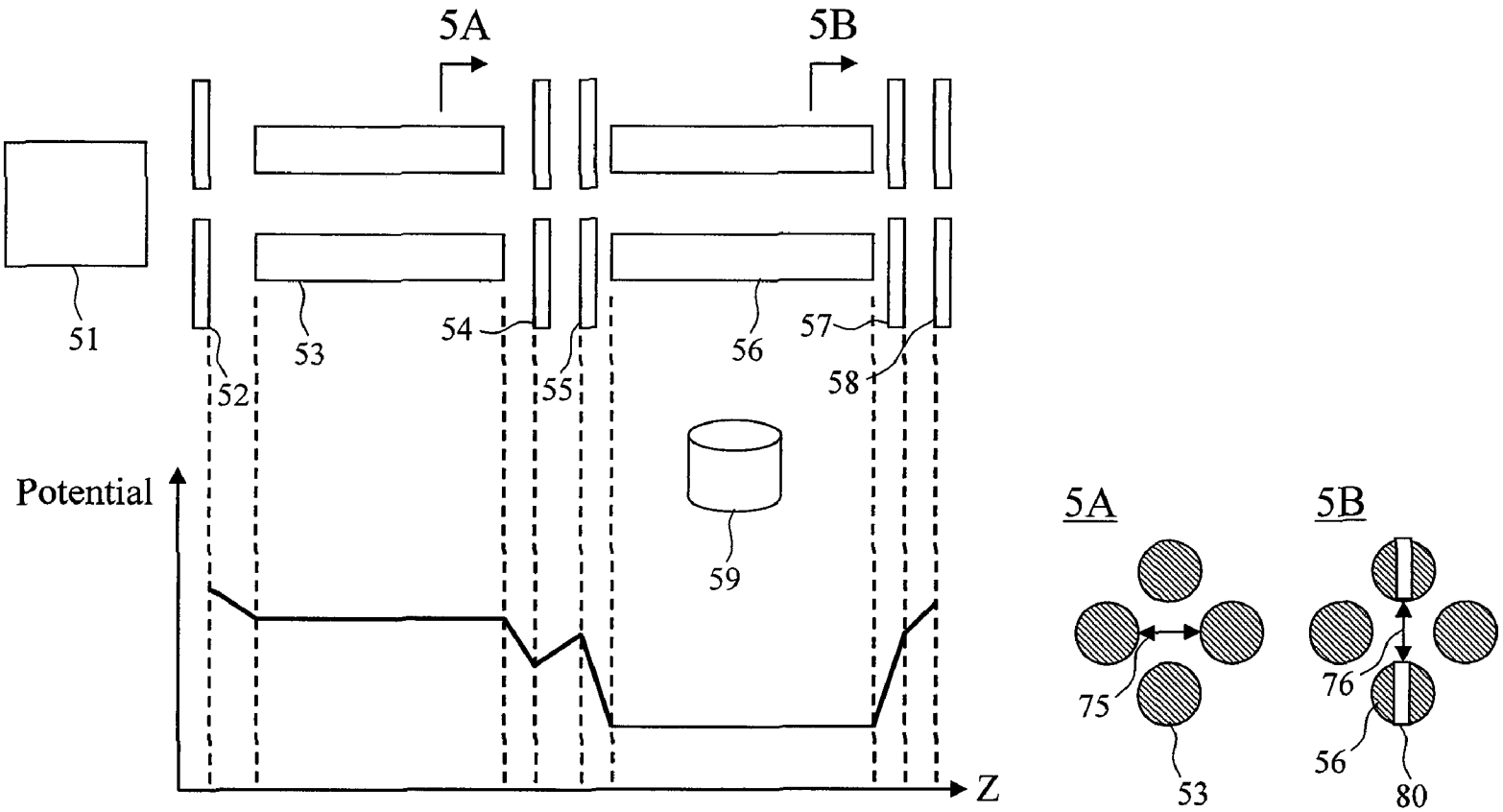
FIG. 5 shows Embodiment 3 of the present system.

FIG. 5 is a configuration diagram of a third embodiment of a linear ion trap to which the present system is applied. In Embodiment 1 and Embodiment 2, ion traps of a type in which a wire electrode is used in the first ion trap portion were used. However, the present embodiment uses a linear ion trap of a type in which a fringing field that occurs between quadrupole rods and an end electrode is used in the first ion trap portion. In this embodiment, too, the path by which ions travel from the ion source up to the first ion trap portion comprising end electrodes 52 and 54, as well as quadrupole rods 53 is similar. RF voltages (approximately 1 MHz, ±5 kV) whose phases are inverted alternately are applied to the quadrupole rods 53. As a result, a pseudo harmonic potential is formed in a radial direction that is orthogonal to the axial direction of the rods. Further, a voltage of approximately 2-30 V with respect to the quadrupole rods is applied to the end electrodes 52 and 54, thus making accumulation in the axial direction possible in each ion trap portion. In the present embodiment, by superimposing a supplemental AC voltage on opposing quadrupole rods, ions can be resonantly excited in a direction 75 of the quadrupole rods, and ejected by the fringing field. The ions ejected from the first ion trap portion are ejected into the second ion trap portion comprising end electrodes 55, 57, and 58, as well as quadrupole rods 56. The ejected ions can be resonantly excited in a direction 76 of the quadrupole rods by superimposing a supplemental AC voltage on the opposing quadrupole rods 56. The resonantly excited ions are ejected from apertures 80 in the quadrupole rods 56, and are detected by a detector 59. In so doing, the resonant excitation direction 75 of the first ion trap portion and the resonant excitation direction 76 of the second ion trap portion are set in orthogonal directions. As a result, as was shown in Embodiment 1, there are effects where cooling in the second ion trap portion proceeds at high speed, and the mass accuracy of the ejected ions is improved.

Embodiment 4

Figure 6:
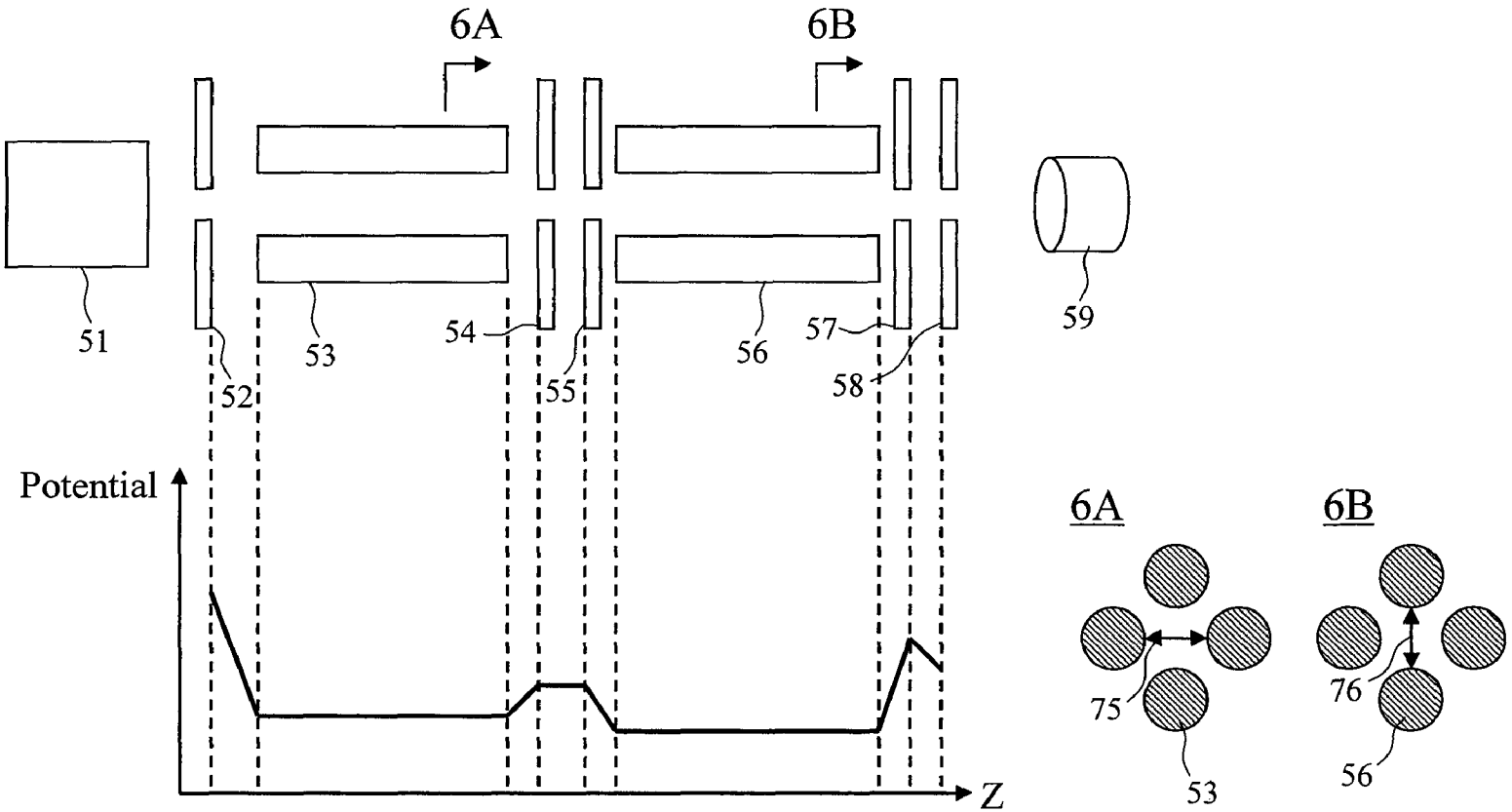
FIG. 6 shows Embodiment 4 of the present system.

FIG. 6 is a configuration diagram of a fourth embodiment of a linear ion trap to which the present system is applied. The present embodiment uses a linear ion trap of a type in which a fringing field that occurs between quadrupole rods and an end electrode is used in the first ion trap portion. In this embodiment, too, the path by which ions travel from the ion source up to the first ion trap portion comprising end electrodes 52 and 54, as well as quadrupole rods 53 is similar. RF voltages (approximately 1 MHz, ±5 kV) whose phases are inverted alternately are applied to the quadrupole rods 53. As a result, a pseudo harmonic potential is formed in a radial direction that is orthogonal to the axial direction of the rods. Further, a voltage of approximately 2-30 V with respect to the quadrupole rods is applied to the end electrodes 52 and 54, thus making accumulation in the axial direction possible in each ion trap portion. In the present embodiment, by superimposing a supplemental AC voltage on opposing quadrupole rods, ions can be resonantly excited in a direction 75 of the quadrupole rods, and ejected by the fringing field. The ions ejected from the first ion trap portion are ejected into the second ion trap portion comprising end electrodes 55, 57, and 58, as well as quadrupole rods 56. The ejected ions can be resonantly excited in a direction 76 of the quadrupole rods by superimposing a supplemental AC voltage on the opposing quadrupole rods 56. The resonantly excited ions are ejected in the axial direction by a fringing field that occurs between the quadrupole rods 56 and the end electrode 57, and are detected by a detector 59. In so doing, the resonant excitation direction 75 of the first ion trap portion and the resonant excitation direction 76 of the second ion trap portion are set in orthogonal directions. As a result, as was shown in Embodiment 1, there are effects where cooling in the second ion trap portion proceeds at high speed, and the mass accuracy of the ejected ions is improved.

Embodiment 5

Figure 7:
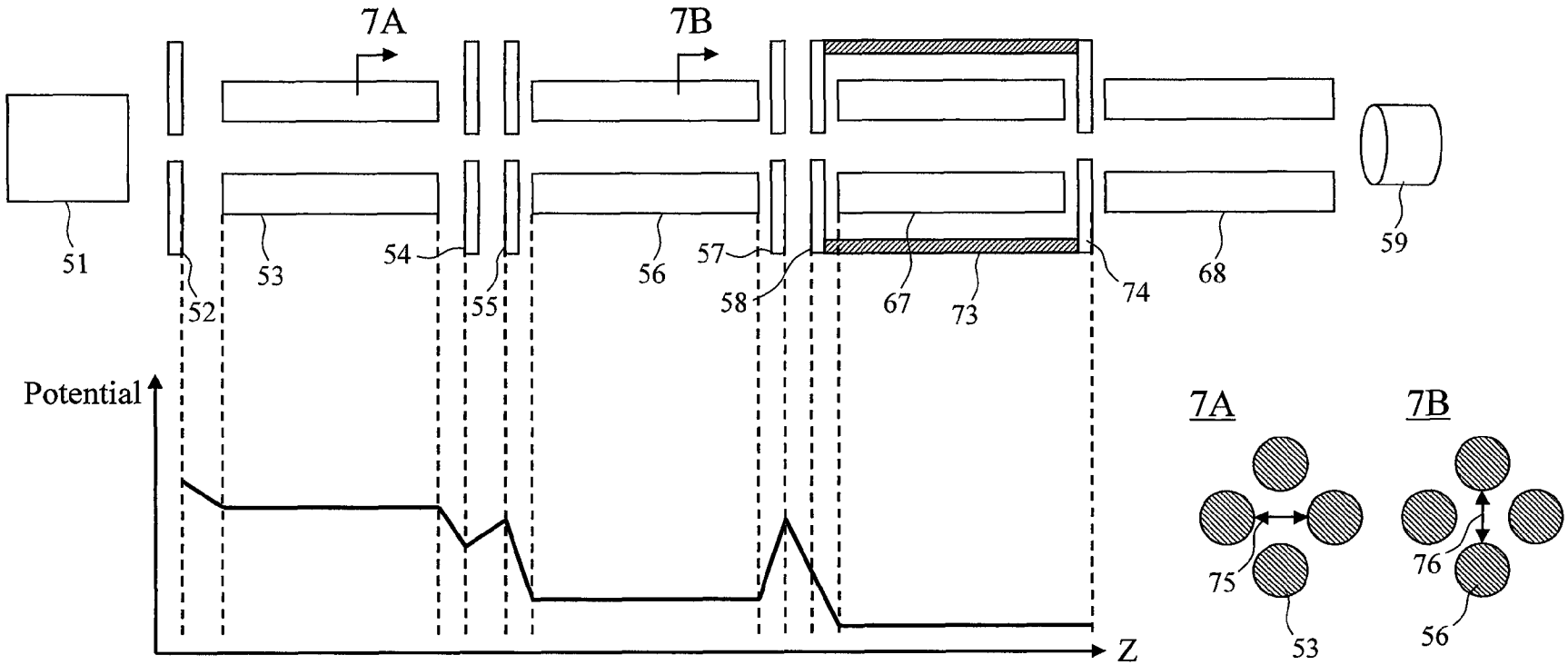
FIG. 7 shows Embodiment 5 of the present system.

FIG. 7 is a configuration diagram of a fifth embodiment in which the present system is applied to a first mass spectrometer (Q1) of a triple quadrupole mass spectrometer. The present embodiment uses a linear ion trap of a type in which a fringing field that occurs between quadrupole rods and an end electrode is used in the first ion trap portion. In this embodiment, too, the path by which ions travel from the ion source up to the first ion trap portion comprising end electrodes 52 and 54, as well as quadrupole rods 53 is similar. RF voltages (approximately 1 MHz, ±5 kV) whose phases are inverted alternately are applied to the quadrupole rods 53. As a result, a pseudo harmonic potential is formed in a radial direction that is orthogonal to the axial direction of the rods. Further, a voltage of approximately 2-30 V with respect to the quadrupole rods is applied to the end electrodes 52 and 54, thus making accumulation in the axial direction possible in each ion trap portion. In the present embodiment, by superimposing a supplemental AC voltage on opposing quadrupole rods, ions can be resonantly excited in a direction 75 of the quadrupole rods, and ejected by the fringing field. The ions ejected from the first ion trap portion are ejected into the second ion trap portion comprising end electrodes 55 and 57, as well as quadrupole rods 56. The ejected ions can be resonantly excited in a direction 76 of the quadrupole rods by superimposing a supplemental AC voltage on the opposing quadrupole rods 56. The resonantly excited ions are ejected in the axial direction by a fringing field that occurs between the quadrupole rods 56 and the end electrode 57. In so doing, the resonant excitation direction 75 of the first ion trap portion and the resonant excitation direction 76 of the second ion trap portion are set in orthogonal directions. As a result, as was shown in Embodiment 1, there are effects where cooling in the second ion trap portion proceeds at high speed, and the mass accuracy of the ejected ions is improved. The ions ejected from the second ion trap portion are introduced into a collision cell comprising end electrodes 58 and 74, quadrupole rods 67, and an outer cylinder portion 73. A gas is introduced into the collision cell by a gas supplying portion (not shown). A noble gas, such as helium, argon or the like, nitrogen, or the like is used as the supplied gas, and the pressure is maintained at approximately $10^{-3}$ Torr to $10^{-2}$ Torr. In the present embodiment, multipole rods are used. However, there also are such types of collision cells as those called traveling wave ion guides in which parallel plates are disposed, and an RF voltage with a different phase is applied to each. Such collision cells may also be used. In addition, instead of collision induced dissociation, other dissociation methods may also be used, including photodissociation by laser irradiation and the like, electron capture dissociation by electron irradiation, and the like. It is possible to control optimum dissociation of the ions by adjusting the potential difference between the offset potential of the quadrupole rods 56 of the second ion trap portion and the offset potential of the quadrupole rods 67 of the collision cell to approximately 5-50 V. After the ions produced by dissociation in the collision cell or the undissociated ions are mass selected by a quadrupole filter (Q3) comprising quadrupole rods, they are detected by a detector 59. By controlling the difference between the ejection mass of the second ion trap portion (Q1) and the transmission mass of the quadrupole filter (Q3) such that it is a constant value, it is possible to improve the sensitivity of a neutral loss scan. By setting the transmission mass of the quadrupole filter (Q3) to a certain value, it is possible to improve the sensitivity of a precursor scan. In the present embodiment, a linear ion trap of the present invention is used for the Q1 portion. However, by using it for the Q3 portion, it is possible to improve the sensitivity of a product ion scan. In addition, in the present embodiment, a type of linear ion trap that uses the fringing fields occurring between the quadrupole rods and the end electrodes is used for the first ion trap portion and the second ion trap portion. However, the present invention is effective even with other combinations of linear ion traps as long as the resonant excitation directions of the first ion trap portion and the second ion trap portion are orthogonal.

Embodiment 6

Figure 8:
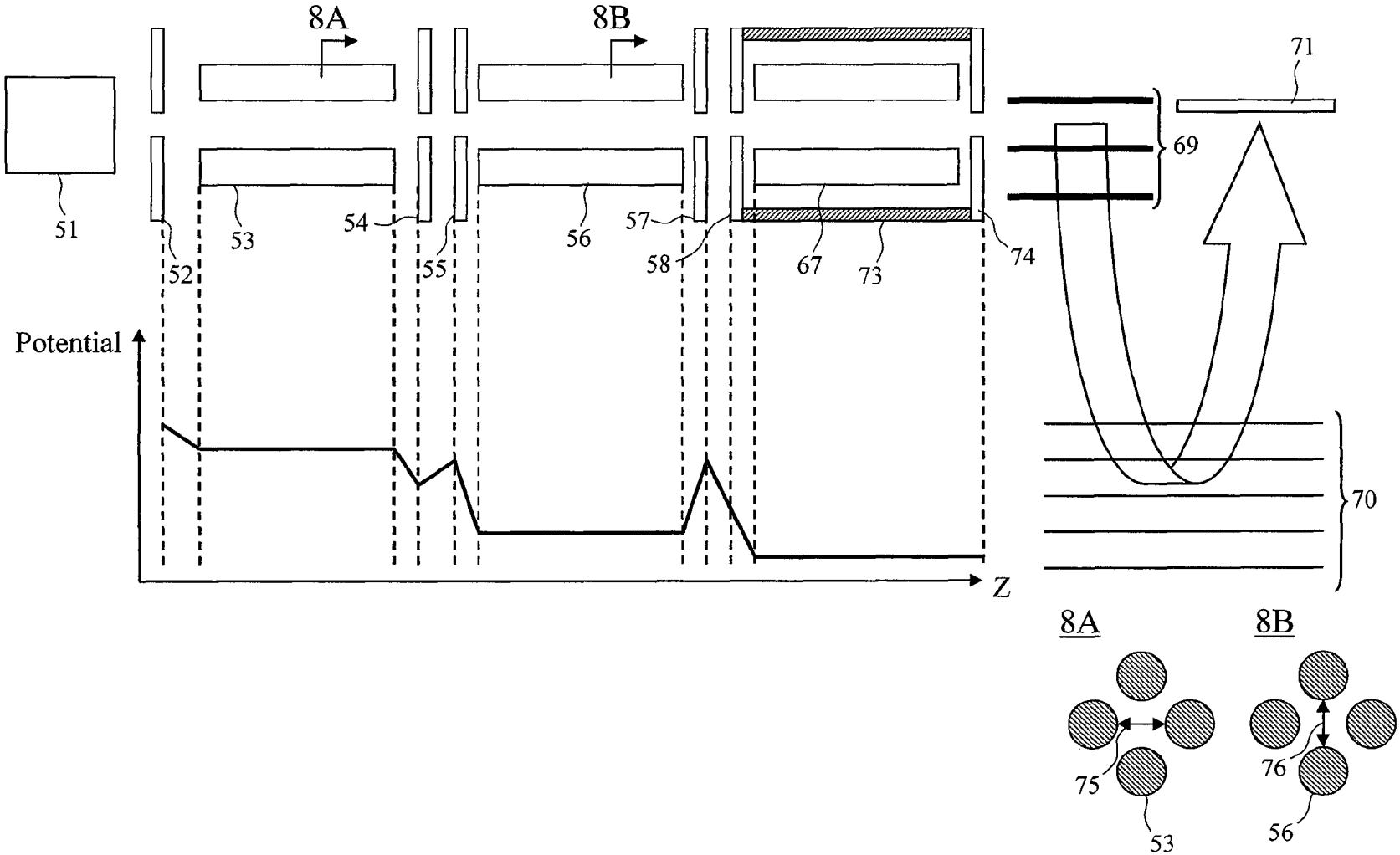
FIG. 8 shows Embodiment 6 of the present system.

FIG. 8 is a configuration diagram of a sixth embodiment in which the present system is applied to a first mass spectrometer (Q1) of a quadrupole time-of-flight mass spectrometer. In this embodiment, too, the path by which ions travel from an ion source 51 up to the first ion trap portion comprising end electrodes 52 and 54, as well as quadrupole rods 53 is similar. RF voltages (approximately 1 MHz, ±5 kV) whose phases are inverted alternately are applied to the quadrupole rods 53. As a result, a pseudo harmonic potential is formed in a radial direction that is orthogonal to the axial direction of the rods. Further, a voltage of approximately 2-30 V with respect to the quadrupole rods is applied to the end electrodes 52 and 54, thus making accumulation in the axial direction possible in each ion trap portion. In the present embodiment, by superimposing a supplemental AC voltage on opposing quadrupole rods, ions can be resonantly excited in a direction 75 of the quadrupole rods, and ejected by the fringing field. The ions ejected from the first ion trap portion are ejected into the second ion trap portion comprising end electrodes 55 and 57, as well as quadrupole rods 56. The ejected ions can be resonantly excited in a direction 76 of the quadrupole rods by superimposing a supplemental AC voltage on the opposing quadrupole rods 56. The resonantly excited ions are ejected in the axial direction by a fringing field that occurs between the quadrupole rods 56 and the end electrode 57. In so doing, the resonant excitation direction 75 of the first ion trap portion and the resonant excitation direction 76 of the second ion trap portion are set in orthogonal directions. As a result, as was shown in Embodiment 1, there are effects where cooling in the ion trap portion of a subsequent stage proceeds at high speed, and the mass accuracy of the ejected ions is improved. The ions ejected from the second ion trap portion are introduced into a collision cell comprising end electrodes 58 and 74, quadrupole rods 67, and an outer cylinder portion 73. A gas is introduced into the collision cell by a gas supplying portion (not shown). A noble gas, such as helium, argon or the like, nitrogen, or the like is used as the supplied gas, and the pressure is maintained at approximately $10^{-3}$ Torr to $10^{-2}$ Torr. In the present embodiment, multipole rods are used. However, there also are such types of collision cells as those called traveling wave ion guides in which parallel plates are disposed, and an RF voltage with a different phase is applied to each. Such collision cells may also be used. In addition, instead of collision induced dissociation, other dissociation methods may also be used, including photodissociation by laser irradiation and the like, electron capture dissociation by electron irradiation, and the like. It is possible to control optimum dissociation of the ions by adjusting the potential difference between the offset potential of the quadrupole rods 56 of the second ion trap portion and the offset potential of the quadrupole rods 67 of the collision cell to approximately 5-50 V. The ions produced by dissociation in the collision cell or the undissociated ions are detected by a time-of-flight mass spectrometer comprising an accelerating electrode 69, a reflectron 70, and a detecting portion 71. In addition, in the present embodiment, a type of linear ion trap that uses the fringing fields occurring between the quadrupole rods and the end electrodes is used for the first ion trap portion and the second ion trap portion. However, the present invention is effective even with other combinations of linear ion trap portions as long as the resonant excitation directions of the first ion trap portion and the second ion trap portion are orthogonal.

In all of the embodiments above, energy distribution in the second ion trap portion is minimized by making the resonant excitation directions of the first iron trap portion and the second ion trap portion, which are controlled in coordination, orthogonal. However, as long as they are in a range of 60°-120°, some effect will be present where the energy distribution is similarly reduced to approximately 50% or lower.

In addition, the linear ion trap portions of the present embodiments comprise quadrupole rods. By applying AC voltages and DC voltages suitable thereto, they may also be used as quadrupole filters.

What is claimed is:

1. A mass spectrometer, comprising:

an ion source that ionizes a sample;

a plurality of linear ion trap portions that are disposed at stages subsequent to the ion source, and in which trapping and mass selective ejection of ions are performed;

a detector that is disposed at a stage subsequent to the plurality of linear ion trap portions, and that detects ions; and a control portion that controls a voltage applied to electrodes forming the plurality of linear ion trap portions, wherein the control portion applies the voltage in such a manner that resonant excitation directions, in radial directions that are orthogonal to an axial direction of the linear ion trap portions, of ions trapped in, of the plurality of linear ion trap portions, adjacent linear ion trap portions are different.

2. The mass spectrometer according to claim 1, wherein the control portion applies the voltage in such a manner that the resonant excitation directions, in the radial directions that are orthogonal to the axial direction of the linear ion trap portions, of the ions trapped in, of the plurality of linear ion trap portions, the adjacent linear ion trap portions are substantially orthogonal.

3. A mass spectrometer, comprising:

an ion source that ionizes a sample;

a first linear ion trap portion that traps the ions ionized by the ion source;

a second linear ion trap portion that traps ions that are mass selectively ejected from the first linear ion trap portion;

a detector that is disposed at a stage subsequent to the second linear ion trap portion, and that detects ions; and a control portion that controls a voltage applied to electrodes forming the first linear ion trap portion and the second linear ion trap portion, wherein the control portion applies the voltage in such a manner that resonant excitation directions, in radial directions that are orthogonal to an axial direction of the linear ion trap portions, of the ions trapped in the first linear ion trap portion and of the ions trapped in the second linear ion trap portion are different.

4. The mass spectrometer according to claim 3, wherein the control portion applies the voltage in such a manner that the resonant excitation directions, in the radial directions that are orthogonal to the axial direction of the linear ion trap portions, of the ions trapped in the first linear ion trap portion and of the ions trapped in the second linear ion trap portion are substantially orthogonal.

5. The mass spectrometer according to claim 3, further comprising vane electrodes between quadrupole rods of at least one linear ion trap portion of the first linear ion trap portion and the second linear ion trap portion, wherein the control portion resonantly excites the ions trapped in the at least one linear ion trap portion by applying an AC voltage to the vane electrodes.

6. The mass spectrometer according to claim 5, wherein the quadrupole rods forming the first linear ion trap portion and the second linear ion trap portion are the same.

7. The mass spectrometer according to claim 3, wherein the control portion resonantly excites the ions trapped in the first linear ion trap portion by applying an AC voltage to first quadrupole rods of the first linear ion trap portion, and resonantly excites the ions trapped in the second linear ion trap portion by applying an AC voltage to second quadrupole rods of the second linear ion trap portion.

8. The mass spectrometer according to claim 3, wherein the control portion applies the voltage in such a manner that resonantly excited ions are ejected in the axial direction of the quadrupole rods by forming an extraction field.

9. The mass spectrometer according to claim 3, wherein the control portion applies the voltage in such a manner that resonantly excited ions are ejected in the axial direction of the quadrupole rods by using a fringing field.

10. A mass spectrometer, comprising:

a first mass spectrometer portion that mass selects ions;

a dissociating portion that dissociates the ions mass selected by the first mass spectrometer portion; and a second mass spectrometer portion that mass selects the ions dissociated by the dissociating portion, wherein either the first mass spectrometer portion or the second mass spectrometer portion is the mass spectrometer according to claim 1.

11. A mass spectrometer comprising:

a first mass spectrometer portion that mass selects ions:

a dissociating portion that dissociates the ions mass selected by the first mass spectrometer portion; and a second mass spectrometer portion that mass selects the ions dissociated by the dissociating portion, wherein the first mass spectrometer portion is the mass spectrometer according to claim 1, and the second mass spectrometer portion is a time-of-flight mass spectrometer.

12. A mass spectrometry method that uses a mass spectrometer in which ions generated by an ion source are introduced, and which comprises two or more linear ion trap portions, the mass spectrometry method comprising:

a step of resonantly exciting in a first resonant excitation direction ions trapped in a first linear ion trap portion of the two or more linear ion trap portions, and mass selectively ejecting the ions in a center axial direction of quadrupole rods;

a step of trapping in a second linear ion trap portion the ions ejected from the first linear ion trap portion, resonantly exciting the trapped ions in a second resonant excitation direction that is different from the first resonant excitation direction in radial directions that are orthogonal to an axial direction of the linear ion trap portions, and mass selectively ejecting the ions; and a step of introducing the ions ejected from the second linear ion trap portion to a detection process.

13. The mass spectrometry method according to claim 12, wherein the first resonant excitation direction and the second resonant excitation direction are substantially orthogonal in the radial directions that are orthogonal to the axial direction of the linear ion trap portions.

14. The mass spectrometry method according to claim 12, wherein the resonant excitation of the ions is performed through resonant excitation by a supplemental AC field.

15. The mass spectrometry method according to claim 14, wherein the supplemental AC field is formed by applying a supplemental AC voltage to vane electrodes inserted between the quadrupole rods of the linear ion trap portions.

16. The mass spectrometry method according to claim 14, wherein the supplemental AC field is formed by applying a supplemental AC voltage to the quadrupole rods.

17. A mass spectrometer, comprising:

a first mass spectrometer portion that mass selects ions;

a dissociating portion that dissociates the ions mass selected by the first mass spectrometer portion; and a second mass spectrometer portion that mass selects the ions dissociated by the dissociating portion, wherein either the first mass spectrometer portion or the second mass spectrometer portion is the mass spectrometer according to claim 3.

18. A mass spectrometer comprising:

a first mass spectrometer portion that mass selects ions;

a dissociating portion that dissociates the ions mass selected by the first mass spectrometer portion; and a second mass spectrometer portion that mass selects the ions dissociated by the dissociating portion, wherein the first mass spectrometer portion is the mass spectrometer according to claim 3, and the second mass spectrometer portion is a time-of-flight mass spectrometer.

* * * * *

UNITED STATES PATENT AND TRADEMARK OFFICE

CERTIFICATE OF CORRECTION

PATENT NO. : 7,982,182 B2
APPLICATION NO. : 12/472899
DATED : July 19, 2011
INVENTOR(S) : Yuichiro Hashimoto et al.

It is certified that error appears in the above-identified patent and that said Letters Patent is hereby corrected as shown below:

On the title page, please correct (75) Inventors to read:

Yuichiro Hashimoto, Tachikawa (JP);
Hideki Hasegawa, Tachikawa (JP);
"Masayuki" --Masuyuki-- Sugiyama, Hino (JP)

Signed and Sealed this
Thirtieth Day of August, 2011

David J. Kappos

David J. Kappos
*Director of the United States Patent and Trademark Office*